United States Patent [19]

Hawkins et al.

[11] Patent Number: 4,694,757

[45] Date of Patent: Sep. 22, 1987

[54] TUYERE CONSTRUCTION FOR REFUSE BURNING BOILER SYSTEMS

[75] Inventors: Richard A. Hawkins, Columbus; Merle D. Hunter, Orient, both of Ohio

[73] Assignee: The City of Columbus, Ohio, Columbus, Ohio

[21] Appl. No.: 857,492

[22] Filed: Apr. 30, 1986

[51] Int. Cl.[4] ..... F23H 11/10

[52] U.S. Cl. ..... 110/271; 110/257; 110/330

[58] Field of Search ..... 110/234, 235, 255, 257, 110/258, 267–271, 286, 293, 309, 310, 318, 327–329, 182.5, 330; 122/6.6; 266/265, 270

[56] References Cited

U.S. PATENT DOCUMENTS

| | | | |
|---|---|---|---|
| 1,985,625 | 12/1934 | Stowe | 110/271 |
| 2,302,173 | 11/1942 | Beers | 110/271 |
| 2,453,487 | 11/1948 | Beers | 110/271 |
| 2,804,834 | 9/1957 | Rivers | 110/271 |
| 4,398,473 | 8/1983 | Loper | 110/271 |
| 4,434,724 | 3/1984 | Kunkel, Jr. | 110/267 X |

*Primary Examiner*—Albert J. Makay
*Assistant Examiner*—Steven E. Warner
*Attorney, Agent, or Firm*—Francis T. Kremblas, Jr.

[57] ABSTRACT

A refuse fuel burning boiler system incorporating a unique tuyere construction wherein the tuyere plates associated with the conveyor-like stoker grate are hingedly mounted to permit the passage of any hard deposits of metal or glass contaminates which form upon the grate during incineration of the refuse fuel. The tuyere plates and support structure are designed for relatively easy retrofit into an existing conventionally designed refuse burning boiler or be incorporated into a new boiler construction. Vertical pivoting of the tuyere plates is limited by hold-down members installed between adjacent plates. These members further function to fix the lateral position of each plate and form the top of an enclosure over the recess in the support wall in which the plates are pivotally mounted.

3 Claims, 9 Drawing Figures

TUYERE CONSTRUCTION FOR REFUSE BURNING BOILER SYSTEMS

BACKGROUND OF INVENTION

The principle of generating electrical power using refuse materials as the primary fuel has become a very attractive operation particularly for municipally owned power generating systems. Such refuse burning power plants offer a solution to the increasingly troublesome burden of trash disposal further motivated by the economics of utilizing the considerable fuel value of the refuse collected.

However, a particularly troublesome and costly problem encountered in the boilers used in such plants is the excessive breakage of the tuyere structures. The tuyere acts as a barrier to combustible materials falling between the rear boiler wall and the moving stoker grates carrying the refuse fuel through the boiler. Also, these plates function to direct the flow of incoming air through the grate in a desirable manner for combustion and cooling purposes.

The prior conventional boiler constructions utilize a tuyere assembly commonly referred to in the boiler industry as an "air seal", wherein a cast metal plate is mounted to a rear tuyere support wall. the prior tuyere plate included a fish-hook shaped end which is disposed within a trough or recess provided in the support wall. The plates were wedged in the recess by a metal shim. The forward portion of the plate extended over a portion of the path of travel of the grate bars comprising the stoker grate. This construction, while providing relatively easy installation and replacement of a tuyere plate, also provided a tuyere plate essentially fixed relative to engagement with any debris movably carried on the stoker grates.

The nature of such refuse burning boiler operations requires minimum maintenance and downtime schedules in order to approach the necessary economics which justify such operations.

While wear and breakage of the conventional boiler tuyere assembly are expected to occur, the rate of failure of these prior conventional tuyere assemblies in refuse burning power plants has exceeded all prior expectations. In one plant operation, the average life of a conventional tuyere plate was less than three weeks. Scheduling an offline downtime once a month for maintenance and replacement parts failed to reduce the loss of efficiency during this interval caused by operating the boiler with a less than effective tuyere air seal. Studies have shown that inadequate tuyere function may reduce boiler efficiency by as high as approximately 5 percent. This represents a very significant cost on top of the increased losses due to downtime of the boiler and the labor and materials for replacement parts. These losses on an annual basis may exceed seventy-five thousand dollars per boiler.

Such costs dramatically reduce the economic efficiency of the refuse burning power plant concept. Prior to the present invention, this problem has been unsolved and has had detrimental effect of the planning of other communities to build such systems in spite of the relative urgency of solving trash disposal problems and the beneficial effects of fossil fuel conservation. It has been found that the major breakage of the prior tuyere plates and/or support occurs due to pieces of metal or glass carried in the refuse. Upon melting in the high temperature they tend to adhere to the surface of the stoker grate to form a relatively large build-up of knobby-like obstructions. As the moving grate passes under the forward end of these plates, these obstructions engage the leading end of the plate causing significant stresses to the plate and to the tuyere support structure. It has been found that such stresses are often sufficient to break either the plate, the support upon which it is mounted, or both. The breakage caused by such obstructions lead to the significant problems noted above.

SUMMARY OF INVENTION

The present invention relates generally to a tuyere assembly for boiler operations and particularly to improved tuyere plate construction for use in refuse burning boilers for power generating operations.

The improved tuyere plate and mounting support is characterized by a simple, but durable, construction which permits easy installation and maintenance while permitting a controlled vertical pivoting movement of the plate away from the underlying moving stoker grates.

The tuyere plate comprises a conventional piece of flat steel plating provided with a pivot pin fixed to the rear end of the plate via a connecting arm to depend downwardly from the plane of the plate portion.

This relatively inexpensive and simple construction may be used to retro-fit existing boilers by merely being mounted in the same position as the conventional tuyere plates with the pivot pin disposed within the conventional tuyere support mounting recess for relatively free rotation of the forward end of the plate away from the moving grate.

Further, in accordance with present invention, the tuyere plates are fixed against lateral movement and limited in the degree of permitted vertical pivoting by a unique hold-down plate which is easily and quickly removably mounted to the tuyere support. The connecting arm joining the pivot pin and the tuyere plate extends only partially along the lateral extent of the plate and pin to create a slot of predetermined length. The hold-down member is positioned such that one such member extends through adjacently disposed slots in adjacent tuyere plates to permit a single hold-down member to anchor the ends of two adjacent tuyere plates.

This provides both economy of material and labor for required installation and maintenance. Further this construction requires no major design changes to incorporate the same in a new boiler plant in the first instance.

OBJECTS

It is a primary object of the present invention to provide a refuse burning boiler construction wherein the tuyere plates and their support reliably function for their intended purpose with improved durability requiring drammatically less frequent maintenance and repair.

It is another object of the present invention to provide a refuse boiler construction wherein downtime is significantly decreased compared to prior art designs and the average life span of the tuyere plate will be increased by a factor between approximately 12 to 16 times.

It is another object of the present invention to provide apparatus of the type described which promotes greater combustion efficiency as compared to prior means to significantly increase the cost effectiveness of the refuse burning power plant concept.

It is a further object of the present invention to provide apparatus of the type described which increases the useful life of the stoker grate via eliminating the cause of improper air flow distribution.

It is still another object of the present invention to provide a tuyere plate design which is simple and economical and yet provides the drammatically improved performance noted above herein.

IN THE DRAWINGS

DETAILED DESCRIPTION

Figure 1:
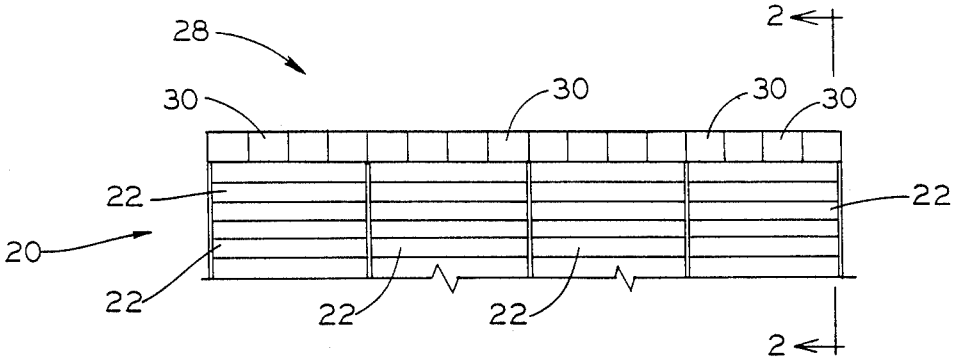
FIG. 1 is a top plan partial view illustrating only the tuyere plates and moving stoker grates constructed in accordance with the present invention.
Figure 2:
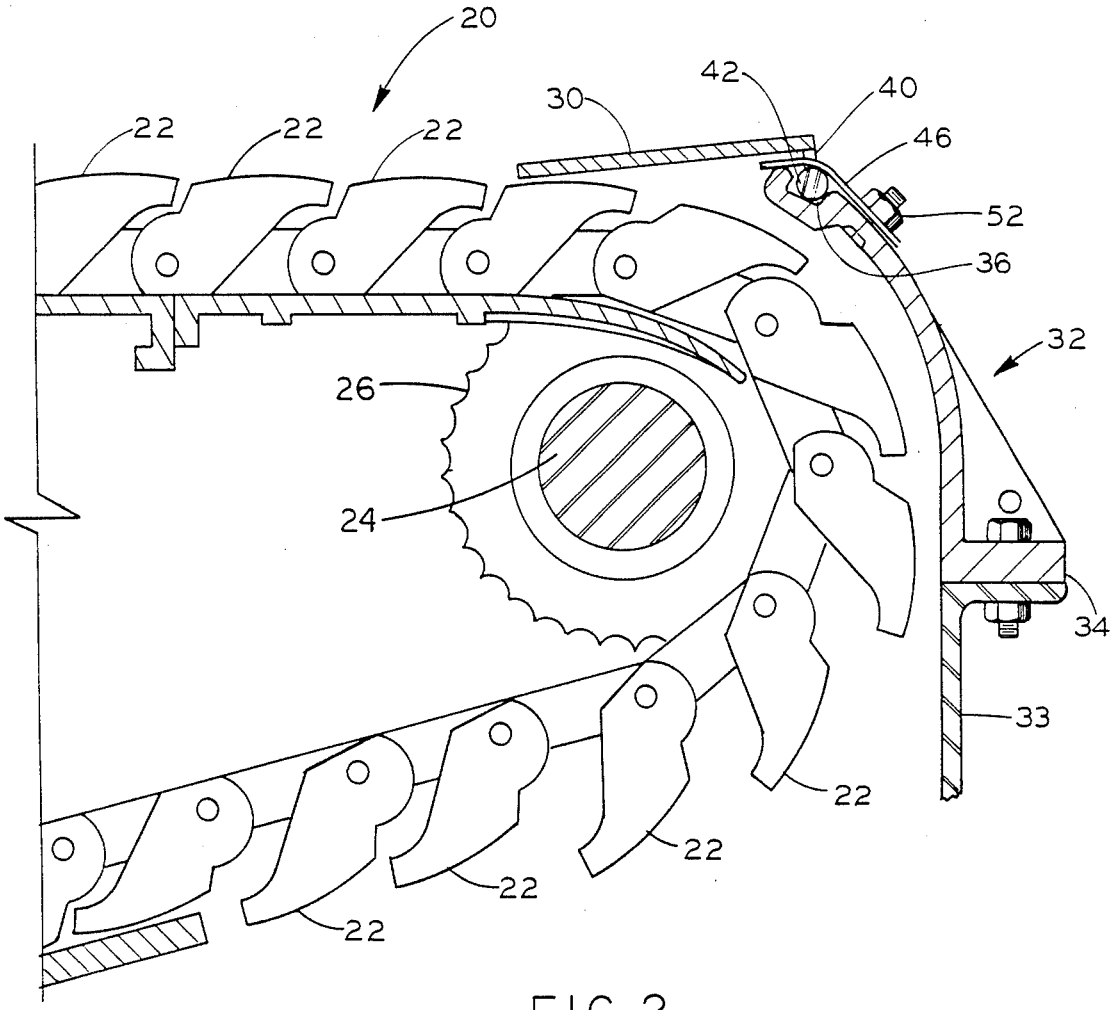
FIG. 2 is a sideway elevational view partially in section of the apparatus shown in FIG. 1.
Figure 3:
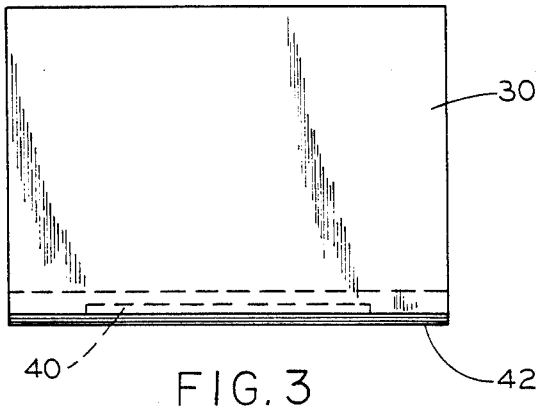
FIG. 3 is a top plane view of one of the tuyere plates shown in the preceding figures illustrated apart from the remaining apparatus.
Figure 4:
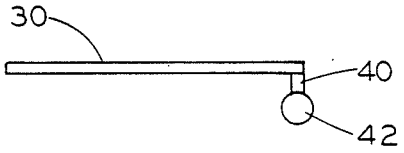
FIG. 4 is a side elevational view of the tuyere plate shown in FIG. 3.

A moving stoker grate utilizing a tuyere plate assembly constructed in accordance with the present invention is illustrated in FIGS. 1 and 2. Such a construction is utilized in an otherwise conventional refuse burning boiler construction, which is diagrammatically illustrated in FIG. 9. Such boiler construction is well-known to those skilled in the art.

Figure 9:
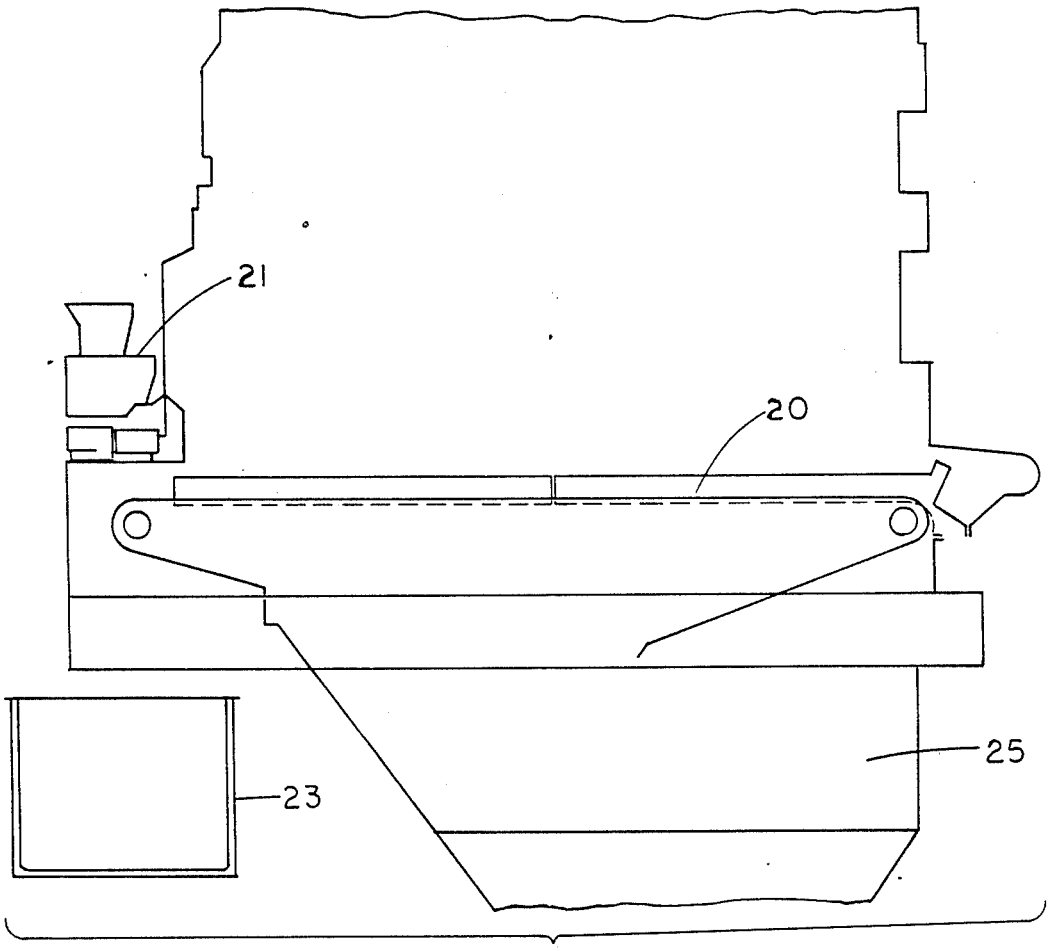
FIG. 9 PRIOR ART
FIG. 9 is a diagrammatic view illustrating the general relationship of the stoker grates to the incoming fuel of a conventional refuse burning boiler construction.

With reference to FIG. 9, the conventional boiler includes a continuous moving stoker grate 20 which receives fuel from an inlet, such as 21 for example, which blows the refuse fuel toward the rear of the stoker grate 20.

As seen in FIG. 9, an ash basin 23 and a sifting hopper indicated generally at 25 are typically provided in conventional boiler constructions. As viewed in FIG. 9, the forward end of stoker grate 20 is to the left which is the direction of travel of the upper surface of the grate as it moves through a continuous repetitive path of travel.

As seen in FIG. 2, only the rear portion of the stoker grate, indicated generally at 20, is shown. Such stoker grates are conventional and comprise a plurality of adjacently disposed grate bars 22 mounted for continuous movement, similar to an endless chain, about a pair of spaced shafts 24, carrying a notched wheel or sprocket 26. The grate bars 22 move counterclockwise as seen in FIG. 2.

The fuel, ground refuse, is blown into the boiler enclosure from a position located to the upper left, as seen in FIGS. 2, and is supported for incineration upon the stoker grate bars 22. The ash is carried by the grate to be deposited in conventional ash basin 23 provided in such boilers. Siftings hopper 25 is disposed under the stoker grate to catch any small ash particles falling from the stoker grate 20 prior to falling from the forward end into the ash basin. In such boiler constructions, air is fed from under the stoker grate to provide combustion air for incineration of the fuel and for the cooling effect upon the stoker grate components.

Adjacent to the rear wall of the boiler, not shown, and extending laterally across the width of stoker grate 20, is a tuyere plate assembly, indicated generally at 28, constructed in accordance with the present invention. Tuyere plate assembly 28 includes a plurality of identical tuyere plates 30 mounted closely adjacent to one another across the rear of the grate 20 to form a barrier to either unburned fuel or air to flow between the stoker grate and rear wall support. Each of the plates 30 extend forwardly to overlie a portion of the path of travel of grate bars 22 as they move around sprocket 26 and travel forwardly to receive the refuse fuel added as previously described as shown in FIG. 2.

Each plate 30 is independently mounted to tuyere support walls, indicated generally at 32. Often a conventional tuyere support wall 32 is divided into separate sections which are joined at mating flanged sections, such as 34, as best seen in FIG. 2. The lower section 33 is conventionally fixed to the floor or wall of the boiler, not shown. The upper portion of tuyere support wall 32 is curved inwardly to partially overlie that portion of the moving grate bars 22 at a point near the most rearward point of travel.

The upper end of support wall 32 is also conventionally provided with a groove or recess 36 which extends laterally with rear support wall 32 across the width of stoker grate 20.

Each tuyere plate 30, preferably of stainless steel for durability, includes a short connecting arm 40 which is fixed to the rear end of plate 30 and extends downwardly to join a pivot pin or rod 42.

Arm 40 may be connected to plate 30 and rod 42 in any suitable manner, such as by welding or the like, which firmly fixed the arm, pin and plate assembly together.

Figure 5:
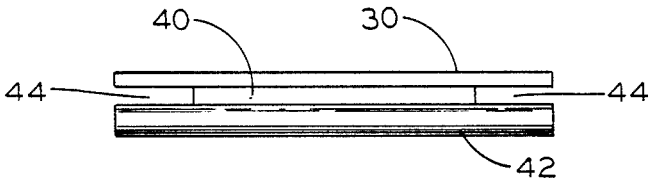
FIG. 5 is a rear elevational view of the tuyere plate shown in FIGS. 3 and 4.

As best seen in FIG. 2 and FIG. 5, pin 42 extends laterally the width of plate 30, however, rod 42 is centered between them and extends only partially across their width to form an open-ended slot 44 at opposing outer ends.

Each plate 30 is mounted in closely and spaced adjacent relationship to one another by simply inserting its respective rod 42 within recess 36 along the length of its axis. A hold-down member 46 is provided to secure each plate in its desired position and to limit the degree of vertically upward pivoting to a predetermined angle. Preferably this angle of pivoting is determined by the desired upward distance the forward end of plate 30 may freely move away from grate bars 22 as may be necessary to provide sufficient clearance to allow any solid obstruction adhered to a grate bar to pass without applying undue stress upon the plate 30 or the upper portion of tuyere wall 32.

Figure 6:
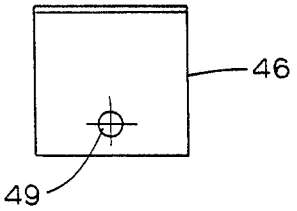
FIG. 6 is a front elevantional view of a hold-down member forming a portion of the apparatus shown in FIGS. 1 and 2.
Figure 7:
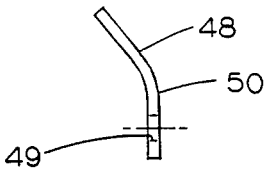
FIG. 7 is a side elevational view of the hold-down member shown in FIG. 6.
Figure 8:
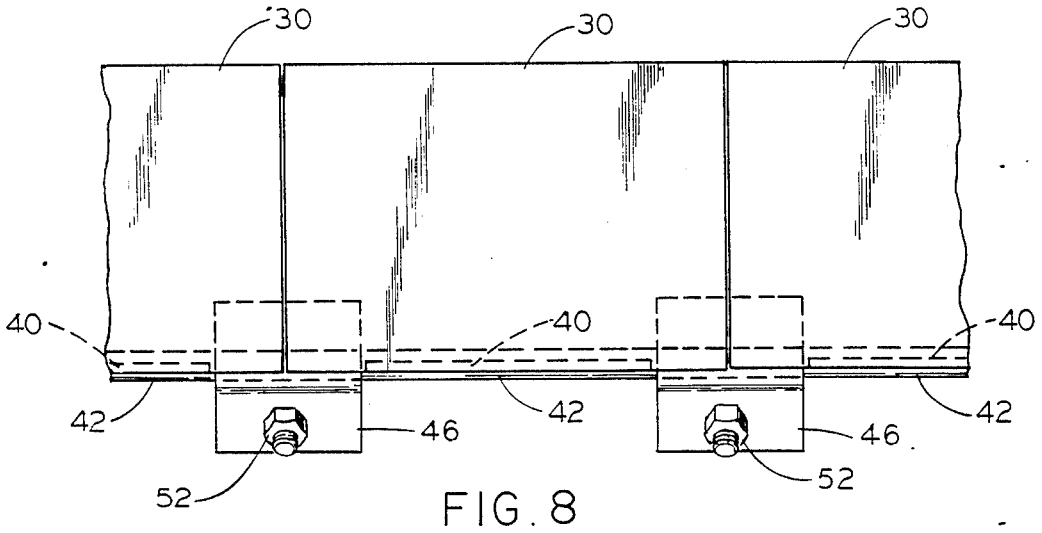
FIG. 8 is a partial top plan view illustrating the tuyere plates and hold-down members forming a portion of the apparatus shown in FIGS. 1 and 2.

Referring to FIGS. 6 and 7, hold-down member 46 comprises a sturdy metal plate having a curved or arcuate upper portion 48 and a lower portion 50 provided with an opening 49 to receive a threaded fastener, such as 52. A threaded hole is conventionally provided in support wall 32 and is adapted to receive fastener 52 which is disposed to position hold-down member 46 in the altitude shown in FIGS. 2. As seen in FIG. 2, the curved upper portion extends through the open-ended slots 44 of adjacently disposed plates 30. This structure forms a cover or lid-like enclosure over recess 36 with sufficient clearance to form a hinge permitting rod 42 to pivot within recess 36. The adjacent plates 30 are secured against lateral displacement by the respective hold-down members 46 as they extend through a respective slot 44 and abut the respective ends of connecting arms 40.

The degree of upward pivoting of plate 30 is limited by hold-down member 46 wherein the upper surface of curved portion 48 forms a stop upon engagement with the rearward edge of plate 30. Therefore, plate 30 is free to pivot upwardly until the rear edge thereof engages the upper surface of hold-down member 46. It has been found that approximately three and one-half to four inches of vertical clearance is sufficient to permit safe passage of almost all obstructions likely to form on stoker grate 20 as previously described. Limiting the pivoting movement is important to assure that plate 30 does not pass the vertical and fail to return to its normal position overlying the stoker grate and resting thereupon after engagement with a metallic or glass obstruction adhered to a passing grate bar 22.

In operation of the refuse burning boiler, ground refuse fuel is blown into the boiler from the forward or upper left end of the stoker grate 20, as seen in FIGS. 2, toward the rearward end thereof. The stoker grate 20 conventionally forms a bed for the incinerating refuse with the ash being transported to the forward end and dumped into a conventional ash basin 23 disposed below the forward end of the stoker grate.

Incoming air is conventionally fed from below the stoker grate 20 upwardly through the grate bars 22 to provide combustion air and to cool the components of stoker 20. Each grate bar 22 is typically provided with through holes, not shown, to accomodate the passage of relatively cool incoming air.

The conventional and primary functions of the tuyere plates and support structure is twofold. First, it tends to prevent unburned or partially burned refuse fuel from falling between the rear of the stoker grate 20 and the back wall of the boiler. Additionally it acts to minimize any significant amount of incoming air to flow upwardly around the rear of the stoker grate instead of passing through and around the stoker grate bars 22. This aspect is particularly important to extend the life of the grate bars 22 while also maintaining the more desirable distribution of combustion air to most efficiently burn the fuel.

The excessive breakage and failure rate of the prior conventional tuyere plate construction often resulted in significant efficiency losses due to air flowing through the void created by one or more broken tuyere plates. Further, without the desired flow of air, due to a break in the tuyere plate assembly, studies indicate that as high as a fifty percent reduction in the useful life of the grate bars 22 can result due to the inefficient cooling thereof by the incoming air flow path.

Additionally, such frequent breakage of the prior tuyere assembly was calculated to cause as much as a five percent reduction in combustion efficiency. On an annual basis this was estimated to cause a loss of over one hundred thousand dollars.

The reduction of stoker grate life and loss of combustion efficiency referred to above was calculated on a basis of a once a month shut-down frequency which is much higher and costly than reasonably desired. Yet, it was not sufficient to reduce the harmful effects noted above.

Utilizing the tuyere plate construction of the present invention has drammatically improved the boiler operation relative to combustion efficiency and repair and maintenance and replacement parts involving tuyere plates, rear wall support castings and stoker grate bars. In addition, the less frequent maintenance and replacement schedules require less boiler down time and a significant savings of labor costs.

In a four boiler operation, the savings directly resulting from utilizing the tuyere plate construction of the present invention represents a conservative estimated savings of approximately $275,000.00 on an annual basis.

From tests conducted on site in a refuse burning power plant operation, it appears that the tuyere plate assembly constructed in accordance with the present invention will provide a useful life average of approximately at least twelve months compared to the average of three weeks for the prior art tuyere plate assembly. Clearly maintenance and replacement costs, downtime and labor are drammatically improved.

The discovery of a solution to this problem of tuyere plate and support failure represents a very significant forward step to further boost the efforts to increase usuage of refuse burning power plants throughout the country. This important concept represents an important effort in the necessary conservation efforts which become more vital to society and also offer many municipalities a viable solution to growing refuse disposal problems.

What is claimed is:

1. An improved tuyere assembly for a refuse burning boiler of the kind having a conventional continuously moving stoker grate defining a path of travel for refuse from a rear wall to a forward wall of said boiler comprising, in combination, a tuyere support wall disposed adjacent to said rear wall of said boiler and spaced near to the rear of said stoker grate, said support wall having an arcuate upper portion extending above a portion of the path of travel and laterally across said stoker grate generally at a right angle to said path of travel; a plurality of tuyere plates horizontally disposed in closely adjacent relationship to one another and extending laterally across a portion of the path of travel of said stoker grate, said plates being independently mounted at their rearwardly disposed edge to said support wall for vertical pivoting movement about a substantially constant horizontal axis with their forwardly disposed edge freely engaging the moving upper surface of said stoker grate and means fixed to said support wall to limit the angle of the vertically upward pivoting movement of any one of said plates independent from another to an angle less than ninety degrees, whereby vertically raised foreign obstructions which adhere upon the surface of said stoker grate during combustion may pass under said tuyere plates by forcing said plates to pivot vertically away from said stoker grate.

2. In an improved tuyere plate and support assembly for refuse burning boiler provided with a moving stoker grate having an upper surface for support of the refuse fuel, the improvement comprising, in combination, a rear tuyere support wall disposed near but spaced from a rearwardly disposed end of said stoker grate, said support wall including a laterally extending recess across the width of said stoker grate and overlying at least a portion of the path of travel thereof; a plurality of horizontally disposed tuyere plates connected to said tuyere support wall in close adjacent relationship to one another to form a barrier extending across the width of said stoker grate, each of said plates including a generally planar surface extending forwardly in overlying relationship to a portion of said moving stoker grate and having a forwardly disposed end freely engaging the upper surface of the stoker grate and a rearwardly disposed end, said rearwardly disposed end of said planar surface provided with a laterally extending downwardly depending pivot arm fixed to a horizontally extending pivot pin, said pivot pin being rotatably disposed within said recess provided in said rear support wall; and a plurality of hold-down members removably fixed to said rear support wall in laterally spaced relationship to one another, each of said members provided with an arcuate upper end overlying at least a portion of said recess to prevent upward displacement of the pivot pin of a tuyere plate from said recess; whereby each of said plates are mounted for vertical pivoting movement responsive to engagement with an immovable obstruction adhered to and raised above the surface of said stoker grate.

3. The assembly defined in claim 2 wherein said pivot arm for each of said tuyere plates is generally centrally disposed relative to the width of said plate and terminates a predetermined lateral distance from the outer edges of said planar surface of said plate to define a laterally extending open-ended slot at each opposing end of said plate between a rear edge of said planar surface and said pivot pin fixed to said pivot arm; and wherein the arcuate upper end of a respective one of said hold-down members is disposed through the open ended slots of an adjacent pair of said plates to enclose a portion of the respective pivot pins associated with said adjacent pair of said plates within said recess and forming a stop means to limit the angle of upward pivoting movement of said plates to a predetermined value less than ninety degrees relative to the horizontal.

* * * * *